US005404943A

United States Patent [19]

Strawn

[11] Patent Number: 5,404,943

[45] Date of Patent: Apr. 11, 1995

[54] MULTIPLE PUMP ASSEMBLY FOR WELLS

[76] Inventor: Wesley O. Strawn, 111 James St., Sequim, Wash. 98382

[21] Appl. No.: 219,826

[22] Filed: Mar. 29, 1994

[51] Int. Cl.[6] ..... F04B 23/04

[52] U.S. Cl. ..... 166/54.1; 166/105; 417/426

[58] Field of Search ..... 166/105, 107, 68, 369, 166/54.1; 417/205, 426, 62

[56] References Cited

U.S. PATENT DOCUMENTS

| | | | |
|---|---|---|---|
| 2,204,857 | 6/1940 | Hollander | 103/106 |
| 2,215,505 | 9/1940 | Hollander | 103/105 |
| 2,242,166 | 5/1941 | Bennett | 103/1 |
| 2,668,500 | 2/1954 | Hoffer | 417/426 X |
| 2,931,304 | 4/1960 | Messey | 166/54.1 |
| 3,170,520 | 2/1965 | Arutunoff | 417/201 |
| 3,602,611 | 8/1971 | Oplander | 417/78 |
| 3,741,298 | 6/1973 | Canton | 166/105 |
| 4,548,263 | 10/1985 | Woods | 166/105 |
| 5,193,614 | 3/1993 | Cox | 166/105 X |
| 5,211,225 | 5/1993 | Crosch | 166/107 X |

*Primary Examiner*—Ramon S. Britts
*Assistant Examiner*—Frank S. Tsay
*Attorney, Agent, or Firm*—R. Reams Goodloe, Jr.

[57] ABSTRACT

A multiple well pump assembly tool. The tool is designed to allow use of multiple submersible pumps in a single borehole. The tool collects the output from two or more pumps and discharges the combined output into the well discharge line. The tool may be utilized for efficiently controlling pump output to meet varying load demands, or alternatively for incrementally increasing output from a deep well. The tool may also be used to provide a primary and a standby pump in a single well bore. The rugged tool assembly is advantageous for pumping deep wells of relatively small diameter where high output is required. In one embodiment, a first header gathers output from a lower pump, and a second header combines that output with the output from a second pump and sends the total output to the well discharge pipe. In another embodiment, one or more intermediate headers are inserted between the lower and the upper header, with each intermediate header collecting the output from a pump attached thereto as well as the combined output from pumps therebelow. One or more longitudinally running integral strengthening ribs are provided in the pump discharge portions which interconnect the various headers to minimize stress fatigue or failure as a result of repeated repressurizations during normal use.

20 Claims, 5 Drawing Sheets

N=2

N=3

MULTIPLE PUMP ASSEMBLY FOR WELLS

TECHNICAL FIELD OF THE INVENTION

This invention relates to apparatus for positioning pumps in wells, and more particularly to an improved apparatus for vertically positioning multiple pumps in a single borehole. The apparatus comprises a tool of improved and strengthened design which may be inserted into a well; the tool supports multiple pumps in their downhole operating positions. The tool may be used to increase the output from a well by combining the outputs of more than one pump, or may be used to efficiently accommodate load swings by varying the output from the well through instrumentation and control of available pumps.

BACKGROUND OF THE INVENTION

It is desirable to utilize multiple pumps in a single borehole for number of reasons. First, multiple pumps may be used to increase the output from a well by combining the outputs of more than one pump. When only single phase power is available, combining multiple pumps to meet requirements is highly desirable. Second, multiple pumps may be utilized to efficiently accommodate a varying output requirement, such as by utilizing one pump for base load requirements and operating a second or subsequent pump only when additional output is desired. Third, some users find that is desirable to utilize one pump as a primary pump, and to maintain a second pump as a backup.

The primary restriction on pump selection for a well is the diameter of the well. Since it is necessary to lower the pump assembly into the well, the well bore must be of sufficient diameter to accommodate the selected pump or pumps. In as much as the cost of drilling a well increases substantially with the diameter of the well, it is desirable to maximize the output obtained from a well by maximizing the pumping capacity placed downhole. Rather than selecting the expensive alternative of increasing the bore diameter of a well in order to accommodate multiple pumps in a side-by-side fashion, one solution which has heretofore been proposed is to supplement a first well pump with a second well pump positioned below it in the well bore.

One problem which must be overcome with such a solution is that the discharge line from the first pump must be accommodated with respect to the placement of the second pump. In other words, the use of a second pump necessitates adapting the cross-sectional shape of the discharge pipe from the lower pump to accommodates the shape of the pump thereabove. This problem is further aggravated by the fact that the lower pump is supported by its discharge pipe within the well bore. Thus, the discharge pipe is continuously subjected to various stresses. The weight of the lower pump is by its discharge pipe. When the pump operates, any vibration, including those generated when stopping and starting, are transmitted to the discharge pipe. Also, repeated pressurization by the pump of the discharge pipe, and depressurization upon cessation of operation, subjects the discharge pipe to stress cycling.

Unfortunately, in the prior art designs for such multiple pump tools which are known to me, over extended periods of time the varying mechanical stresses and strains on the discharge pipe combined with the internal fluid pressure cycling has resulted in deformation and occasional rupturing of such parts. Further, many of the heretofore available designs known to me are likely to deform to an extent that makes retrieval from the well difficult, if not impossible. Also, many of the pump tool designs heretofore proposed do not provide what I consider to be an adequate system for structural reinforcement to insure long life downhole and retrievability of the tool as desired., Therefore, a continuing demand exists for a simple, inexpensive and reliable multiple pump tool assembly. More particularly, there exists a demand for a multiple pump tool assembly which provides a good structural design to assure long service life.

Several multiple pump tool assemblies of the character described above which provide to some limited extent the general capabilities desired have heretofore been proposed. Those of which I am aware are disclosed in U.S. Pat. Nos.: 4,548,263 issued Oct. 22, 1985 to B. E. Woods for FITTING FOR DUAL SUBMERSIBLE PUMPS; and 3,741,298 issued June 26, 1973 to Lawrence J. Canton for MULTIPLE WELL PUMP ASSEMBLY.

For the most part, the documents identified in the preceding paragraph disclose devices which have one or more of the following shortcomings: (a) they lack sufficient structural design to minimize deformation, and as a result, (b) their design fails to assure long service life or retrievability of the tool and appended pumps.

Therefore, there still remains an unmet and increasingly important need in the field for a vertically disposed multiple pump assembly which is designed and manufactured in a way that assures sufficient structural strength to withstand years of use and which have the assurance that retrieval from downhole is possible whenever required. Thus, the advantages of the reinforced and structurally sound design of my multiple well pump tool assembly are important and self-evident.

OBJECTS, ADVANTAGES, AND NOVEL FEATURES

From the foregoing, it will be evident to the reader that the primary object of the present invention resides in the provision of a novel multiple well pump tool assembly with an integral reinforcing structure that is rigorously and soundly designed.

It is a further object of the present invention to provide a multiple well pump tool assembly:

which does not allow excessive deformation;

which minimizes the possibility that a tool would fail in use so as to impair or prevent the retrievability of the tool from a well;

allows three or more pumps to be reliably operated from a single tool.

Other also important but more specific objects of the invention reside in the provision of a multiple pump tool assembly with integral stiffening members in accord with the preceding objects:

which allow one to preselect the size of the a primary and secondary pump so that incremental pumping capacity can be provided in a single well;

which allow a primary pump and a back-up pump to be located in a single well;

which allows a reduction in above ground water storage requirements;

which is capable of resisting deterioration by cyclic pressurization, corrosion or erosion during many years of use with a variety of well waters, which is rugged and durable;

which, in conjunction with the integral stiffening members, are designed to be retrievable from the well after years of use;

which provides a mechanically strong lower pump discharge pipe design and thus a more durable pump assembly;

which provides a lower pump discharge pipe design that is simple to construct and to maintain;

which is easy to install by unskilled or semiskilled labor.

While the present invention is generally described with reference to and as an improvement upon earlier multiple drinking water well pump tool assemblies, it should be understood that the tool assembly with integral stiffening members as taught herein may be suitable for utilization with a variety of borehole pumping applications, such as with waste water, solution mining applications, or oil field service.

Other important objects, features and additional advantages of the invention will be apparent to the reader from the foregoing and from the appended claims as well as from the ensuing detailed description and discussion of the invention in conjunction with the accompanying drawing.

SUMMARY OF THE INVENTION

The present invention provides a multiple well pump assembly tool for vertically coupling a desired number N pumps in a well. In one form the tool includes a lower header having a lower side with an inlet adapted to receive the output from a first or lower pump, the header forming a fluid tight compartment having sidewalls and an outlet to a first or lower pump discharge portion, and an upper header having lower side with an inlet adapted to receive the output from a second pump, the upper header forming a fluid tight compartment having sidewalls and an inlet from the lower pump discharge portion, and an outlet adapted for connection to well discharge piping. Preferably, the lower pump discharge portion further includes one or more reinforcing ribs which connect the interior wall with the outer wall to provide tensioning members to integrally strengthen the pump discharge portion when pressurized during use.

The multiple well pump assembly tool provides the ability to utilize three or more pumps by way of using one or more intermediate headers which collect the output from the pumps below as well as the pump located at that header, and send the collected output to the next header thereabove.

The pump discharge portions may be fabricated from slot and insert portions utilizing curved plate and ribs which are joined by fillet welds. Alternatively, the integrally strengthened discharge portions may be fabricated from unitary, one-piece cast, extruded, or molded parts.

BRIEF DESCRIPTION OF THE DRAWING

Where appropriate, like reference numerals will be used throughout the various figures to indicate like parts without further comment thereon.

DESCRIPTION

Figure 1:
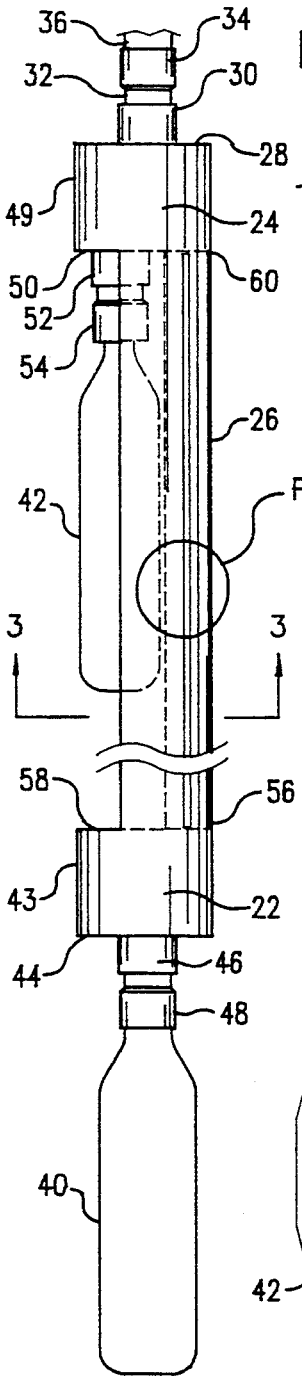
FIG. 1 is a side elevation view of a multiple pump tool assembly fabricated in accord with the present invention, as if installed in a well casing (not shown).

Attention is directed to FIG. 1 of the drawing where the multiple pump tool assembly designated generally as 20 is shown in a vertical, side view, as if installed in a water well (well casing not shown). The major components of tool 20 are a first or lower header $H_1$ 22, a second or upper header $H_2$ 24, and a first lower pump discharge conduit portion 26 which hydraulically interconnects the first header 22 with the second header 24. Tools such as tool 20 may be configured with a sequence of headers comprising a first header $H_1$ through an Nth header $H_N$, from the bottom to the top of the tool to connect any desired number N pumps together in a single tool in a borehole. Generally, one header is provided for each pump. P in a series of pumps arranged from the bottom to the top of the tool and which may be described by the sequence $P_1, \ldots P_N$. The upper or second header 24 (where N=2) has a top portion 28 which includes an outlet 30. The outlet 30 is shown configured as an internally threaded coupling which is connected by a short pipe stub 32 to a well tool assembly outlet check valve 34, which is in turn connected to the well discharge pipe 36. However, the outlet 30 may be fabricated in a variety of conventional piping techniques known to those skilled in the art to which this specification is addressed. Outlet check valve 34 serves to prevent backflow of water downward into tool 20 when neither of the lower 40 nor upper 42 pumps are operating. The use of a check valve 34 at the tool 20 discharge to the well discharge pipe 33 is generally recommended in water wells when the well being pumped is two hundred or more feet deep.

The first or lower header 22 is a hydraulically tight compartment which has peripheral sidewalls 43 and a lower side 44 having an inlet 46 therein which receives fluid from pump 40 after passage of the fluid through check valve 48. Similarly, the second (assuming N=2) or upper header 24 is a hydraulically tight compartment with peripheral sidewalls 49, and which has a lower side 50 with an inlet 52 therein which receives fluid from pump 42 after passage through check valve 54. It is recommended that each pump 40 and 42 utilize the check valves 48 and 54 respectively to prevent back-flow at each pump 40 or 42 when that pump is not operating.

The first lower pump discharge conduit portion 26 has an inlet end 56 positioned at the top side 58 of first header 22, and a discharge end 60 located at the bottom side 50 of the upper header 24. This first lower pump discharge conduit portion 26 conducts fluid which is pumped by pump 40 from the first or lower header 22 to the upper or N header 24, which is the second header in the two pump system shown. Since the number of lower pump discharge conduit portions provided equals N−1, here, where N=2, there is only a single, or first, lower pump discharge conduit portion.

In a typical application for a small, eight (8) inch bore water well, headers 22 and 24 would generally be provided in a cylindrical shape, about six and a half (6½) inches in outside diameter and about six (6) to twelve (12) inches in height. The first lower pump discharge conduit portion 26 is normally provided with sufficient length so that is twelve (12) inches or more longer than the anticipated length for a preselected pump 42. Overall, the multiple pump tool assembly 20 would be from about four (4) feet to as much as fifteen (15) feet or more in length. Of course, that length does not include the length of lower pump (and its motor) 40, it being understood that pumps 40 and 42 may be selected from any desired type of pump commonly used in downhole applications, and thus and do not form a part of the tool 20 itself. Therefore, length of the tool assembly 20 with pumps 40 and 42 installed is dependent upon the length of the lower pump 40.

Figure 3:
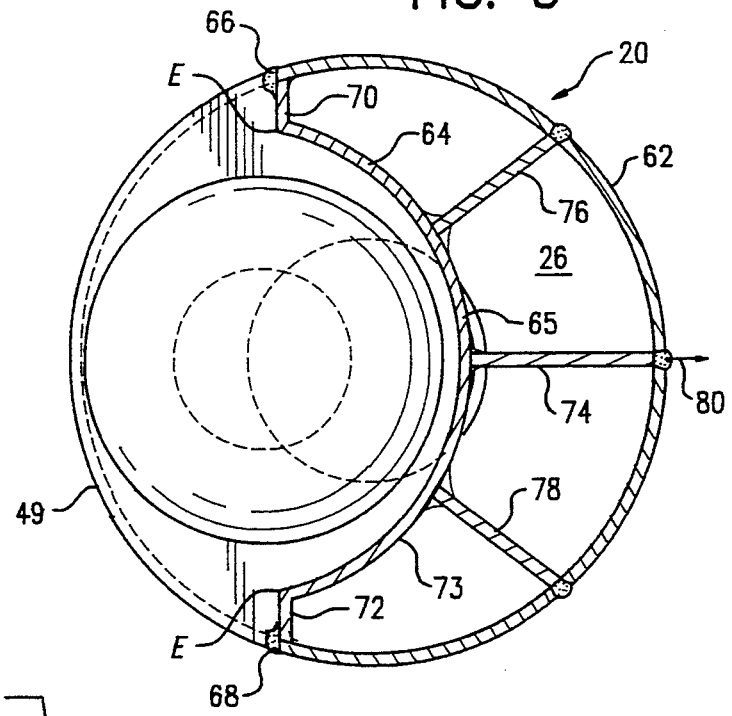
FIG. 3 is an enlarged cross-sectional view of the multiple pump tool assembly taken looking upward at line 3—3 of FIG. 1.

Turning now to FIG. 3, a key portion of the invention is illustrated by the enlarged cross-sectional view provided. This FIG. 3 view is taken looking upward at section line 3—3 of FIG. 1, and shows an enlarged cross-section of the first lower pump discharge conduit portion 26. The first lower pump discharge conduit portion 26 includes an outer wall section 62 and an inner wall section 64, which are joined along lateral seams 66 and 68 to form the fluid tight, fluid conducting, generally crescent shaped tube of pump discharge conduit portion 26. For convenience in fabrication it may be desirable to form inner wall section 64 with laterally spaced apart winglet type edge portions 70 and 72 for attachment at seams 66 and 68, respectively to the outer wall section 62. In such a configuration, the inner wall section 64 is comprised of a crescent shaped central portion 73 and flat winglets 70 and 72 attached to the outer edges E of the central crescent shaped portion 73, so as together provide a hat like or generally u-shaped cross-sectional shape to the inner wall section 64. This configuration is also advantageous for assuring adequate cooling of the adjacent pump, since the crescent shaped portion 73 is preferably sized to match the adjacent pump by providing a minimum of clearance thereto. Thus, the chance of liquids bypassing the pump wall is thereby decreased and the cooling effect on the pump of the liquid flow is increased.

For strength, first rib 74, second rib 76, and third rib 78 are disposed within the fluid conducting pump discharge conduit portion 26. Ribs 74, 76, and 78 are attached to the outer wall section 62 and to the inner wall section 64, in a manner that results in tension of the ribs 74, 76 and 78 which tends to prevent tube 26 from bulging outward (such as outer wall section 62 moving in the direction of reference arrow 80) when the tube 26 is pressurized by fluid pressure therein.

Figure 12:
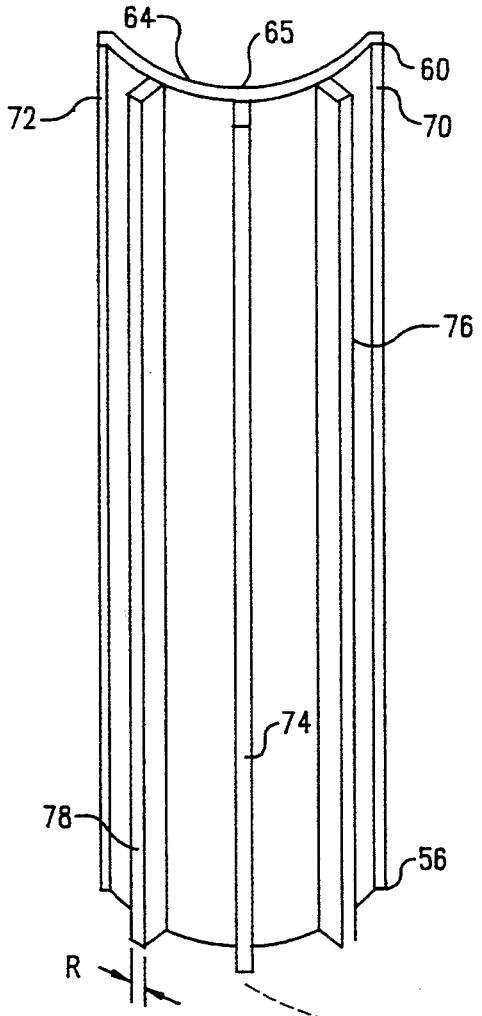
FIG. 12 is a perspective view of an inner side wall of a discharge pipe portion of present invention tool assembly, showing rib location during fabrication.
Figure 13:
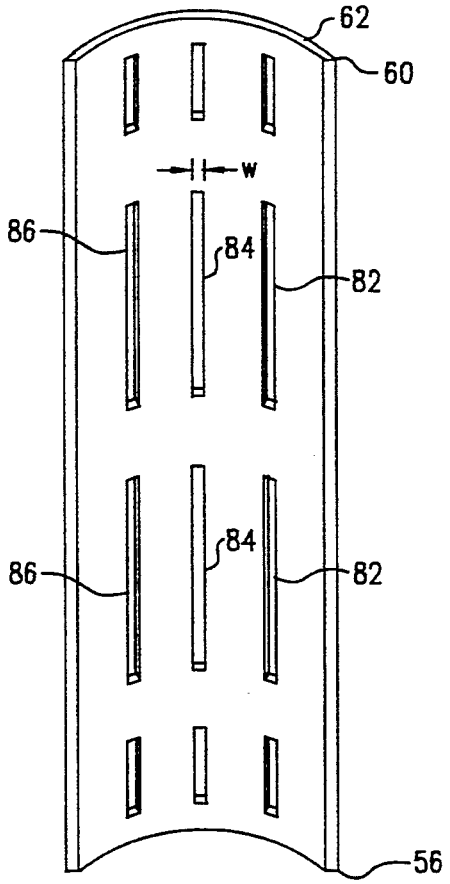
FIG. 13 is a perspective view of an outer side wall of a discharge pipe portion of my tool, showing slot sections ready to receive reinforcing ribs.
Figure 14:
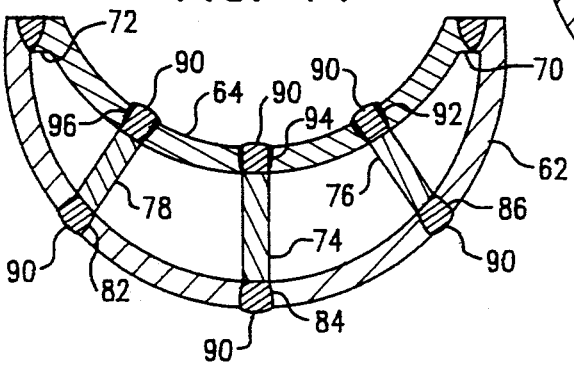
FIG. 14 is a horizontal cross-sectional view showing assembly details of a discharge pipe portion of the present invention tool.

Ribs 74, 76, and 78 are shown extending between the outer wall section 62 and the inner wall section 64. Preferably, ribs 74, 76 and 78 are plates which extend vertically from the inlet 56 end to the discharge 60 end of the first lower pump discharge conduit portion 26. One method of fabrication of the tube 26 with integral stiffening ribs 74, 76, and 78 is depicted in FIGS. 12, 13, and 14 below. As seen in FIG. 13, outer wall section 62 is provided with a plurality of longitudinal slot sections 82, 84, and 86 therein. Preferably, longitudinal slot sections 82 are roughly of width W which is approximately the same as width R of the corresponding rib 74, 76, and 78, which are depicted in FIG. 12. The inner wall 64 is brought to a fabrication position adjacent to outer wall 62 by moving it in the direction noted by reference arrow 88 of FIG. 12. As noted in FIG. 14, a fillet weld 90 is used to attach ribs 74, 76, and 78 to outer wall section 62 at slot sections 82, 84, and 86. Likewise a filet weld 90 is used to join ribs 74, 76, and 78 to inner wall section 64, were slot sections 92, 94, and 96 equivalent in form and function to those shown (82, 84, and 86) in the outer wall 62 are provided.

Figure 2:
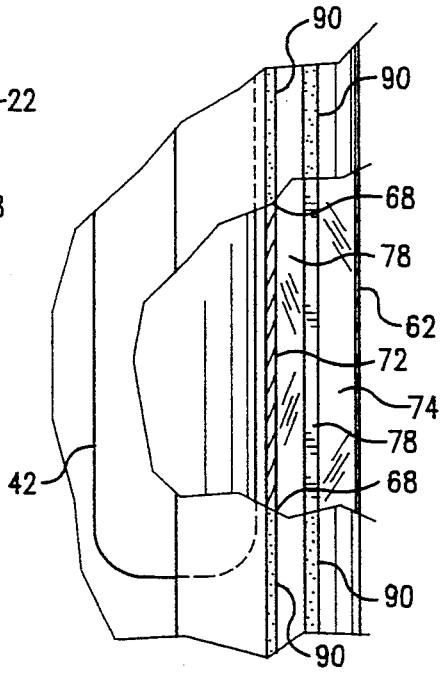
FIG. 2 is an enlarged partially broken away view of the lower pump discharge portion of the tool assembly first shown in FIG. 1.

When the just described method of construction is utilized, is utilized, the structure of bypass 26 can be visualized by the partial cut-away view provided in FIG. 2. In that vertical elevation view, taken from the side of FIG. 1, the seam 68 between wing 72 and outer wall 62 is seen. Likewise, the weld 90 between rib 78 and outer wall 62 is seen. Finally, the location of rib 74 is clearly evident.

Figure 15:
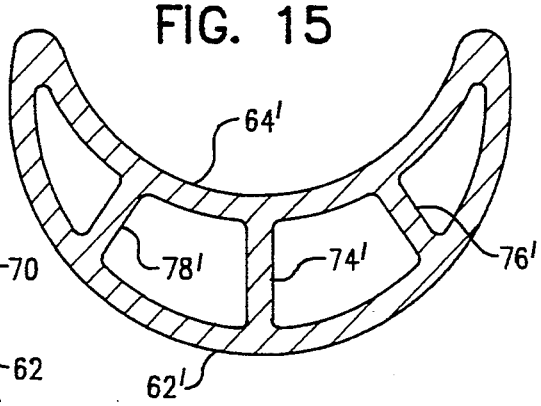
FIG. 15 is a horizontal cross-sectional view showing a discharge pipe portion of unitary, one-piece construction.

An alternate method of construction of pump discharge conduit portion 26 is depicted in FIG. 15. Here, the pump discharge conduit portion 26 is provided in a solid, one-piece, unitary structure 26'. The structure 26' may be fabricated in a variety of methods, which may vary depending upon other structural and corrosion resistance requirements. For instance, it may be from cast aluminum, or extruded aluminum, or from molded plastic, or from a fiber reinforced plastic epoxy. In such cases, the outer wall section 62' and inner wall section 64' are continuously formed with ribs 74', 76', and 78'. Fabrication of the tool is done by casting discharge conduit portion 26' in long lengths, then cutting the lengths as necessary to accommodate the pumps, and then welding the headers (22, 24, etc) to the conduit 26', to form a tool for collection of output from two pumps, or more, as desired. Regardless of the method of construction chosen, the addition of strengthening ribs to the pump discharge conduit portion 26 is of fundamental importance to my invention.

Figure 4:
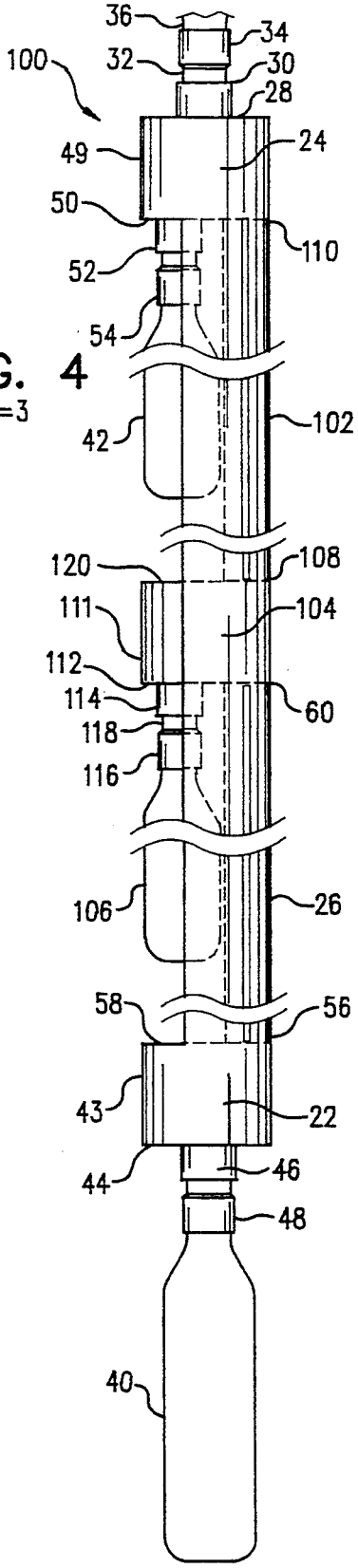
FIG. 4 is a side elevation view of a second embodiment of my invention, showing a three pump tool assembly as if installed in a well casing (not shown).

Turning now to FIG. 4, a multiple well pump tool assembly 100 suitable for coupling three pumps together (the number of pumps N=3) in one tool 100 is provided. Where the number of pumps N is equal to three or more, a sequence of headers comprising a first header $H_1$ through an Nth header $H_N$ and corresponding to an integral number N of pumps is provided, and one or more intermediate headers $H_X$ (such as intermediate header 104) are provided, wherein X is an integer between 1 and N and wherein the sequence of said headers may be described by the sequence $H_1$, $H_X$, . . . $H_N$. As is intuitively obvious in view of the more specific examples set forth below and by use of the various figures of the drawing, the location of any one header $H_X$ may generally be described relative to other headers therebelow, such as $H_{X-1}$ for the header immediately below header $H_X$, or relative to other headers thereabove, such as header $H_{X+1}$ for the header immediately above header $H_X$. The tool 100 is similar to the tool assembly 20 shown in FIG. 1 but for the fact that tool 100 further includes second lower pump discharge portion 102 to supply liquid to the upper header 24 from the intermediate header 104, which gathers liquid from the third pump 106. The intermediate header 104 receives fluid from the lower pump 40 via way of first lower pump discharge conduit portion 26. The header 104 also receives fluid from the discharge of the third pump 106, and these streams are combined for discharge to the inlet end 108 of the second lower pump discharge portion 102 for delivery at the discharge end 110 of second lower pump discharge conduit portion 102 to the upper header 24.

Similar in operation to the first described tool 20, tool 100 is preferably provided with the hydraulically tight intermediate header 104 which has peripheral sidewalls 111 and a lower side 112 having an inlet 114 therein which receives fluid from pump 106, after passage of the fluid through check valve 116 and pipe stub 118. Also, the intermediate header 104 is also provided with an upper side 120 which connects to inlet 108 of the second lower pump discharge conduit portion 102. The second lower pump discharge conduit portion 102 may be configured and fabricated by the same methods as already described for the first lower pump discharge conduit portion 26.

Figure 5:
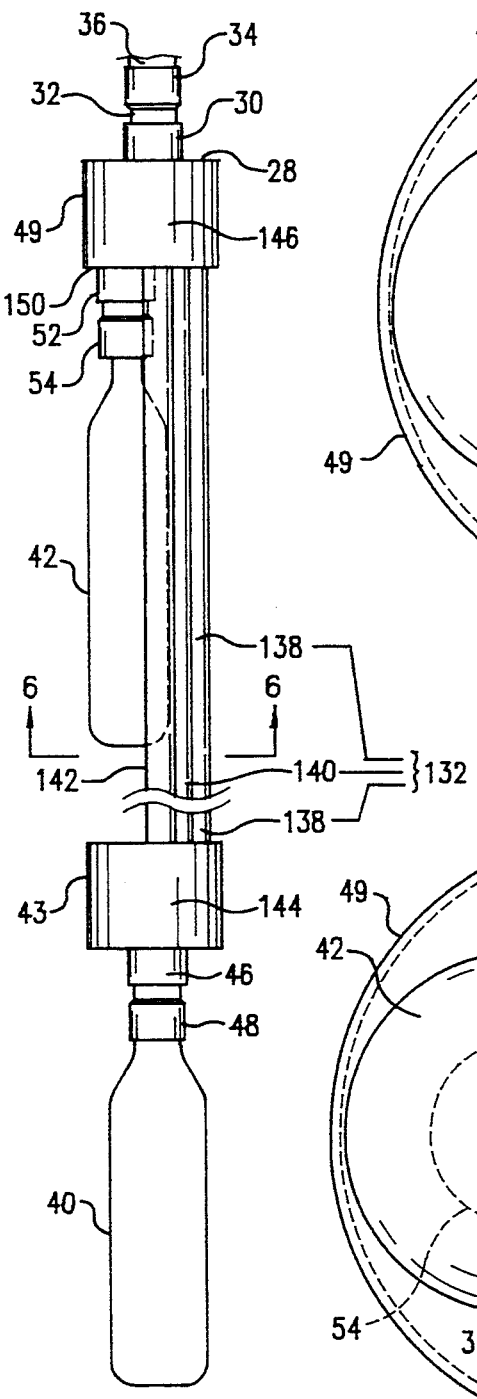
FIG. 5 is a side elevation view of a third embodiment of a multiple pump tool assembly in which the lower pump discharge portion is comprised of tubes.
Figure 6:
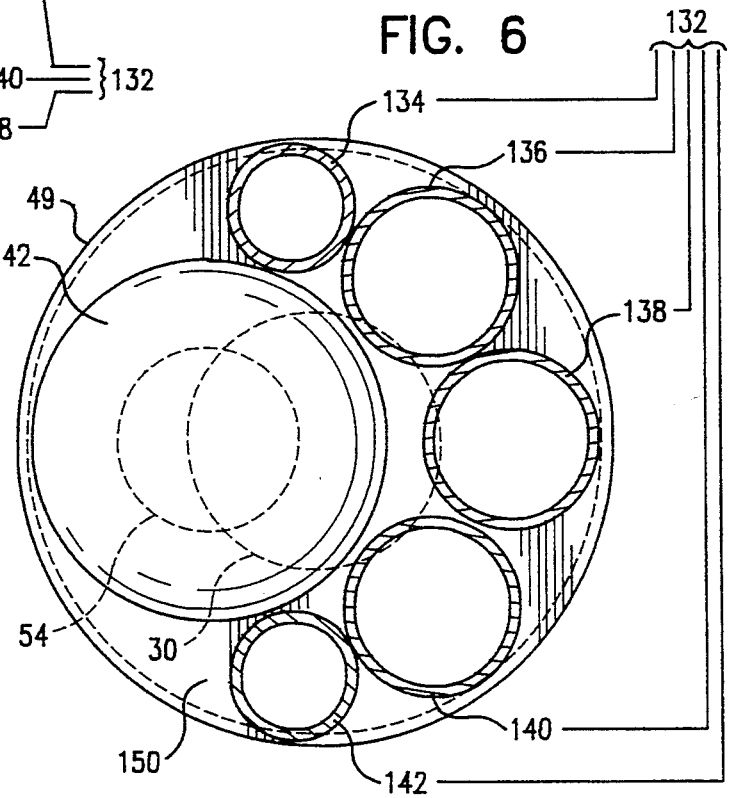
FIG. 6 is an enlarged cross-sectional view taken looking upward at line 6—6 of the tool assembly shown in FIG. 5.

FIG. 5 is a vertical, side elevation view of multiple well pump tool assembly 130 which is fabricated in a somewhat different method to achieve the same long life, adequate strength results as noted in the objectives stated herein above. Here, the first lower discharge pump portion 132 is made up of a plurality of tubular members. As illustrated in FIG. 6, which is an enlarged cross-sectional view taken looking upward along section line 6—6 of FIG. 5 five tubular members, namely tubes 134, 136, 138, 140, and 142 are provided. As in tool 20, the tubes 134, 136, 138, 140, and 142 run between a first or lower header 144 and a second or upper header 146, which are respectfully adapted to discharge and receive the tubes 134, 136, 138, 140, and 142. For example the second or upper header 146 has a lower side 150 which is adapted to receive the aforementioned tubes. If the tubes 134, 136, 138, 140, and 142, have different diameters as shown here, then the outer tubes 134 and 142 have the small diameters relative to the inner most tube 138 which preferably has the largest diameter.

Figure 7:
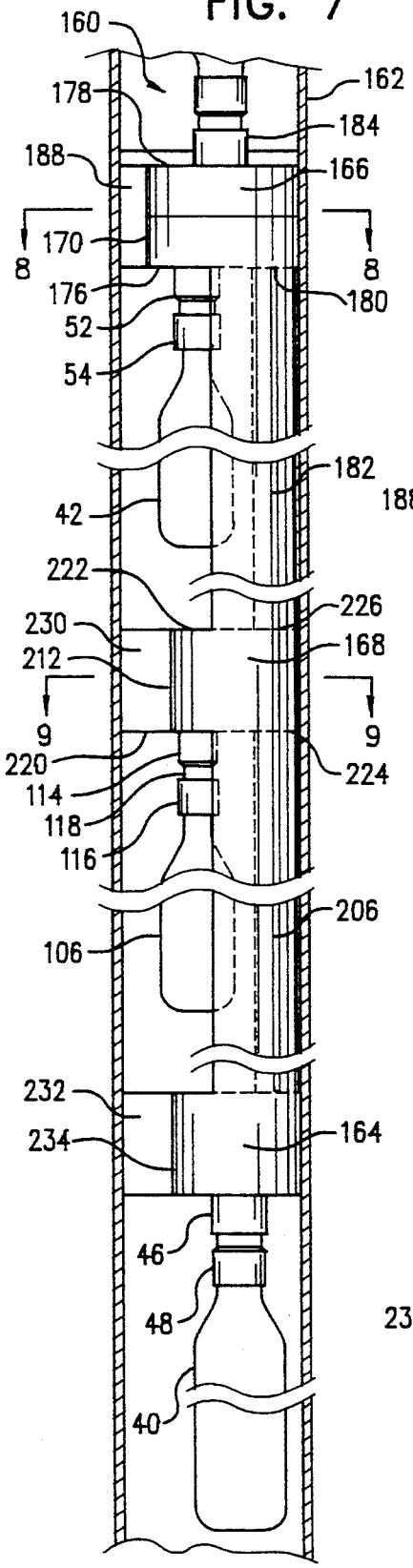
FIG. 7 is a side elevation view of a fourth embodiment of my multiple pump tool assembly this embodiment utilizes a spacer for positioning; the tool is shown in position in a well casing which is shown in vertical cross-section.
Figure 8:
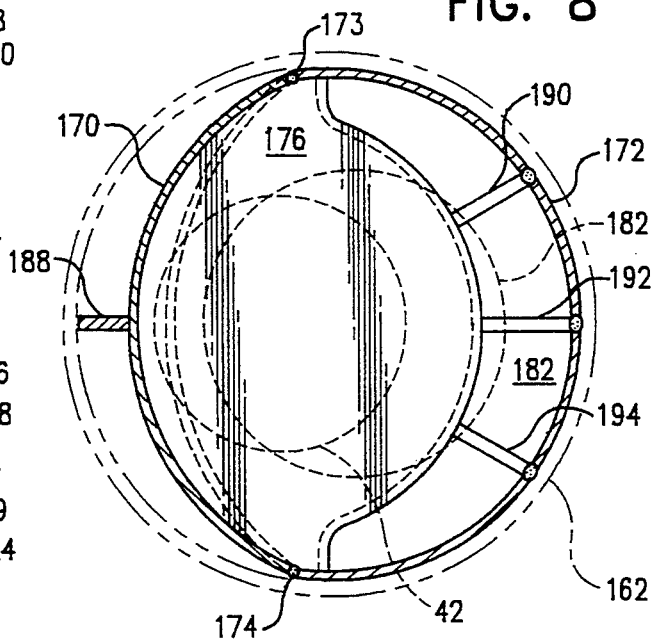
FIG. 8 is an enlarged cross-sectional view of the pump assembly shown in FIG. 7, taken looking down at line 8—8.
Figure 9:
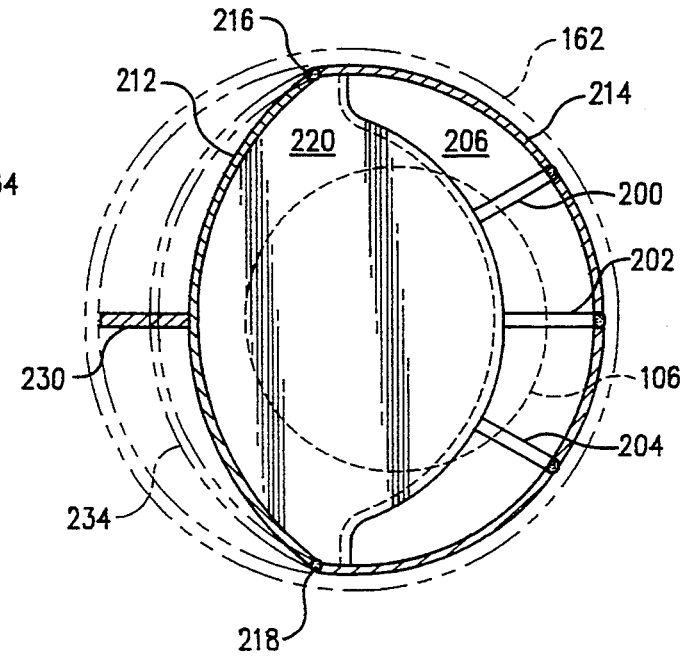
FIG. 9 is an enlarged cross-sectional view of the tool shown in FIG. 7, taken looking down at line 9—9.

Attention is directed to FIG. 7 which shows another embodiment of a multiple well pump tool assembly 160 in a well casing 162. The multiple well pump tool assembly 160 is basically similar to the tool 130 shown in FIG. 4 above, except for the design of headers 164, 166, and 168 of tool 160. The unique design of headers 164, 166, and 168 can be better appreciated by reference to FIGS. 8 and 9, which are enlarged horizontal cross sectional views taken through the second or upper header 166 and through the intermediate or third header 168. In FIGS. 8 and 9, we can see that the headers 166 and 168 are of non-circular cross-section. In FIG. 8, the second or upper header 166 is shown with a first vertical sidewall 170 and a second vertical sidewall 172. The first vertical sidewall 170 segment is preferably provided as a segment of a circle having a diameter somewhat larger than that of the well casing 162, or of the borehole, regardless of whether or not a casing is utilized. On the other hand, the second vertical sidewall 172 segment is preferably provided as a segment of a circle having a diameter slightly less than that of the well casing 162. These segments 170 and 172 are joined at lateral seams 173 and 174. A bottom side 176 and a top side 178 are provided for header and sealingly affixed to vertical sidewalls 170 and 172 sealingly to form a fluid tight header having an inlet 180 from the intermediate pump discharge portion 182 and an outlet 184 provided on the top side 178.

On the first vertical sidewall segment 170 of header 166 a spacer 188 is affixed, preferably projecting radially outward towards the well casing 162. This spacer 188 allows tool 160 to be easily inserted in well casing 162. Spacer 188 also enhances fluid passage through the tool 140 location in the well, as well as provides structural support against outward expansion of header 166. As in other embodiments, ribs 190, 192, and 194 are provided for strength in the intermediate pump discharge portion 182. Similar ribs 200, 202, and 204 are provided in the lower pump discharge portion 206.

FIG. 9 is an enlarged cross-sectional view taken along line 9—9 of FIG. 7. It is similar to FIG. 8 but it has a wider spacer 210 than the spacer 188 utilized in upper header 166. In this view, the intermediate header 168 is shown with a first vertical sidewall 212 and a second vertical sidewall 214. The first vertical sidewall 212 segment is preferably provided in a diameter somewhat larger than that of the well casing 162. On the other hand, the second vertical sidewall 214 segment is preferably provided in a diameter slightly less than that of the well casing 162. These segments 212 and 214 are joined at lateral seams 216 and 218. A bottom side 220 and a top side 222 are provided for header 168 and are sealingly affixed to vertical sidewalls 212 and 214 to form a fluid tight header having an inlet 224 from the lower pump discharge portion 206 and an outlet 226 on the top side 222 to the intermediate pump discharge portion 182.

On the first vertical sidewall segment 212 of header 168 a spacer 230 is affixed, similar to spacer 188 noted above. Spacer 230 serves to keep vertical sidewall 212 from tending to bulge outward toward well casing 162, and also assists in guiding the tool 160 down the casing when installing the tool 160.

On the first or lower header 164, a spacer 232 is provided affixed to a first vertical sidewall 234, similar in location and function to the other spacers described.

Figure 10:
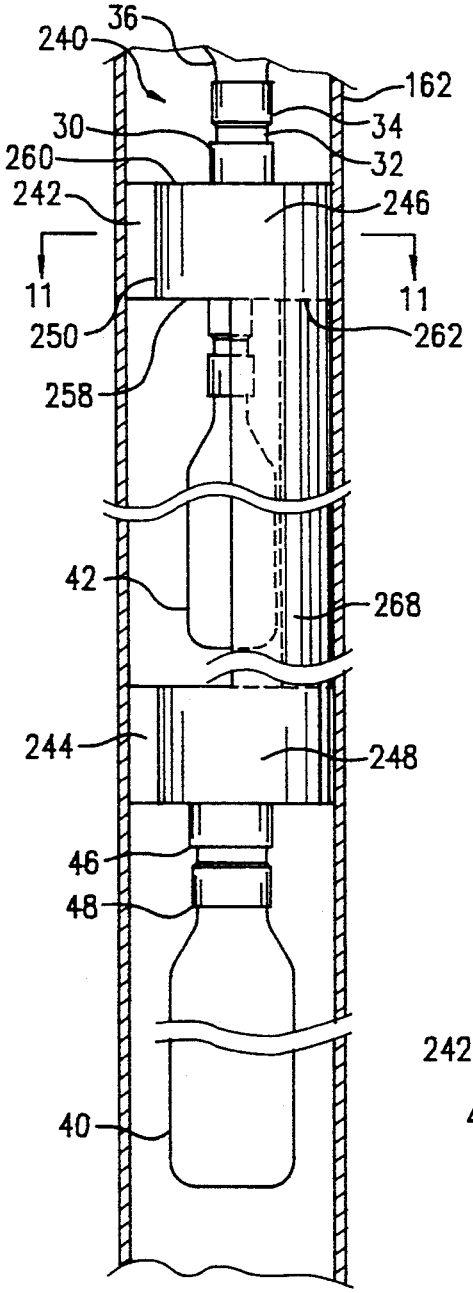
FIG. 10 is a side elevation view of a fifth embodiment of my multiple pump tool assembly, illustrating the use of a spacer in a well casing.
Figure 11:
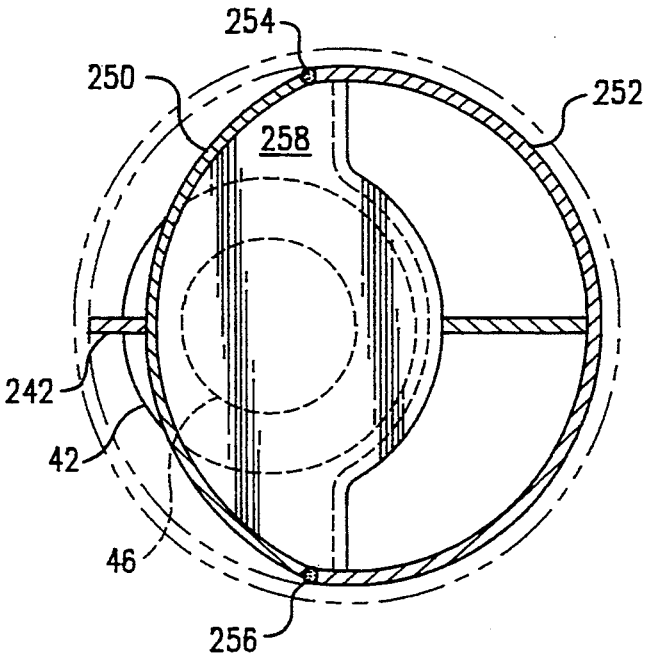
FIG. 11 is an enlarged cross-sectional view of the tool shown in FIG. 10, taken looking down at line 11—11.

In FIGS. 10 and 11, yet another embodiment of my multiple well pump assembly tool is provided. Tool 240 is shown in casing 162. Tool 240 is a two pump assembly which utilizes a vertically disposed spacers 242 and 244 on upper 246 and lower 248 headers, respectively. In this view, the second or upper header 246 is shown with a first or inner vertical sidewall 250 and a second or outer vertical sidewall 252. As for the embodiments earlier described, the first or inner vertical sidewall 250 segment is preferably provided in a diameter somewhat larger than that of the well casing 162. On the other hand, the second vertical sidewall 252 segment is preferably provided in a diameter slightly less than that of the well casing 162. These segments 250 and 252 are joined at lateral seams 254 and 256. A bottom side 258 and a top side 260 are provided for header 246 and are sealingly affixed to vertical sidewalls 250 and 252 to form a fluid tight header having an inlet 262 from the lower pump discharge conduit portion 268 and an outlet 30 on the top side 260 running through check valve 34 to the well discharge line 36.

On the first vertical sidewall segment 250 of header 246 a spacer 242 is affixed, which serves to keep vertical sidewall 250 from tending to bulge outward toward well casing 162, and also assists in guiding the tool 240 down the casing when installing the tool 240.

It is to be appreciated that the multiple well pump assembly tool provided by way of the present invention is a significant improvement in the state of the art of down hole pump assemblies. My tool is of strong, reinforced design and is capable of withstanding many years of service without damaging deformation or deterioration. Further, it can provide great flexibility in use of multiple pumps by allowing the user to avoid multiple well requirements through use of standby or peak loading pumps.

It will be readily apparent to the reader that the present invention may be easily adapted to other embodiments incorporating the concepts taught herein and that the present figures are shown by way of example only and not in any way a limitation. Thus, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalences of the claims are therefore intended to be embraced therein.

I claim:

1. A tool for hydraulically coupling a number N of pumps E for removal of liquid from a borehole, wherein N is a positive integer greater than or equal to two and wherein a sequence of pumps is arranged from the bottom to the top of the tool and which may be described by the sequence $P_1, \ldots P_N$, said tool comprising:

a sequence of headers comprising a first header $H_1$ through an Nth header $H_N$ and corresponding to a number N of pumps and wherein the sequence of said headers may be described by the sequence $H_1, \ldots H_N$, and said first header $H_1$ (22), having peripheral sidewalls (43), a top side (58) and a lower side (44), said lower side further comprising a lower header inlet (46) therein adapted to receive therethrough the output of a first pump $P_1$ (40) hydraulically coupled thereto;

an $H_1$ discharge conduit (26) for conducting pressurized liquid from said first header $H_1$, said $H_1$ discharge conduit generally vertically disposed and sealingly defined between an interfitting outer wall section (62) and inner wall section (64), said inner wall section shaped to allow close fitting placement of said $P_1$ pump adjacent thereto, wherein said $H_1$ discharge conduit further comprises one or more ribs (74, 76, 78) extending between and joined to each of the said outer wall (62) and inner wall (64) sections, said ribs adapted to strengthen said $H_1$ discharge conduit (26), whereby said $H_1$ discharge conduit can receive, contain, and upwardly conduct pressurized liquid exiting from the header $H_1$ immediately therebelow;

a header $H_N$ (24), said header $H_N$ adapted to receive liquids from a header $H_{N-1}$ discharge conduit portion immediately therebelow, said header $H_N$ further comprising peripheral sidewalls (49), and an $H_N$ header lower side (50), said $H_N$ header lower side further comprising an $H_N$ header inlet (52), said $H_N$ header inlet adapted for hydraulic connection to an Nth pump (42), and an $H_N$ header top portion (28), said $H_N$ header top portion further comprising an outlet (30);

said $H_N$ header peripheral sidewalls, $H_N$th header lower side, and $H_N$th header top portion sealing joined and cooperating to form a hydraulically tight receiving chamber, whereby liquid may be discharged from said outlet to a conduit for receiving said liquid from said borehole.

2. The tool of claim 1, wherein said number N is equal to two.

3. The tool of claim 1, wherein N is equal to three or more, and sequence of headers comprising a first header $H_1$ through an Nth header $H_N$ and corresponding to an integral number N of pumps, wherein X is an integer between 1 and N and wherein the sequence of said headers may be described by the sequence $H_1, H_X, \ldots H_N$ said tool further comprising at least one intermediate header $H_X$ (104) adapted to hydraulically contain liquid sent thereto, and a discharge conduit portion $H_X$ (102), and wherein said intermediate header $H_X$ is hydraulically connected to the output from an $H_{X-1}$ discharge conduit portion of header $H_{X-1}$ immediately therebelow, and wherein said intermediate header $H_X$ further comprises (a) peripheral sidewalls (111), (b) an intermediate header $H_X$ inlet (114), for receiving the liquid output of a selected pump $P_X$ (106), and (c) an intermediate header $H_X$ upper side (120), and wherein said intermediate header $H_X$ upper side is hydraulically connected to the inlet (108) of a discharge conduit portion (102) of said intermediate header $H_X$.

4. The tool of claim 3 wherein said number N is equal to three.

5. The tool of claim 1, wherein said peripheral sidewalls of each of said headers $H_X$ in said sequence of headers from 1 to N each further comprises a first vertical sidewall segment (170) and an opposing a second vertical sidewall segment (172), said first vertical sidewall segment and said second vertical sidewall segments each provided in generally concave shape and joined concave side to concave side to form a hydraulically tight seal at the contacting edges therebetween.

6. The tool of claim 2, wherein said first vertical sidewall segment (170) comprises a segment of a circle having a diameter larger than that of the borehole in which said tool is to be placed.

7. The tool of claim 5, wherein said second vertical sidewall segment (172) is of a diameter less than that of the borehole in which said tool is to be placed.

8. The tool of claim 5, wherein said first (170) and said second (172) vertical sidewall segments are sealingly joined at first (173) and second (174) lateral seams.

9. The tool of claim 1, wherein each of said ribs comprises a generally vertical wall, and wherein said ribs extend continuously laterally and vertically from said outer wall section (62) to said inner wall section (64).

10. The tool of claim 3 wherein three ribs are used to strengthen said discharge conduit portions of each of said headers $H_X$.

11. The tool of claim 3 wherein each of said discharge conduit portions of headers $H_X$ are of continuous, one-piece construction.

12. The tool of claim 11, wherein said discharge conduit portions of headers $H_X$ are comprised of cast material.

13. The tool of claim 11, wherein said discharge conduit portions of headers $H_X$ are comprised of molder material.

14. The tool of claim 1, wherein said inner wall section (64), is configured in a generally crescent shape.

15. The tool of claim 1, wherein said inner wall section (64) comprises a generally crescent shape central portion (65) and a pair of winglets (70 and 72) laterally affixed to the outer edge of said crescent shaped central portion, to form a generally U-shaped cross-section for the said inner wall portion, said inner wall portion shaped so that liquids flowing past said inner wall portion must pass adjacent to pump $P_1$, so that pump $P_1$ may be effectively cooled by passage of said liquid thereby.

16. A tool for hydraulically coupling a number N of pumps P for removal of liquid from a borehole, wherein N is a positive integer greater than or equal to two and wherein a sequence of pumps is arranged from the bottom to the top of the tool and which may be described by the sequence $P_1, \ldots P_N$, said tool comprising:

a sequence of headers comprising a first header $H_1$ through an Nth header $H_N$ and corresponding to a number N of pumps and wherein the sequence of said headers may be described by the sequence $H_1, \ldots H_N$, and said first header $H_1$ (22) having peripheral sidewalls (43), a top side (58) and a lower side (44), said lower side further comprising a lower header inlet (46) therein adapted to receive therethrough the output of a first pump $P_1$ (40) hydraulically coupled thereto;

a header $H_1$ discharge conduit for conducting pressurized liquid from said first header $H_1$, wherein said $H_1$ discharge conduit further comprises one or more tubular elements, whereby said $H_1$ discharge conduit can receive, contain, and upwardly conduct pressurized liquid exiting from the header $H_1$ immediately therebelow;

a header $H_N$ (24), said header $H_N$ adapted to receive liquids from a header $H_{N-1}$ discharge conduit immediately therebelow, said header $H_N$ further comprising peripheral sidewalls (49), and an $H_N$ header lower side (50), said $H_N$ header lower side further comprising an $H_N$ header inlet (52), said $H_N$ header inlet adapted for hydraulic connection to an Nth pump (42), and an $H_N$ header top portion (28), said $H_N$ header top portion further comprising an outlet (30);

said $H_N$ header peripheral sidewalls, $H_N$th header lower side, and $H_N$th header top portion sealing joined and cooperating to form a hydraulically tight receiving chamber, whereby liquid may be discharged from said outlet to a conduit for receiving said liquid from said borehole.

17. The tool of claim 16, wherein N is equal to three or more, and comprising a sequence of headers from a first header $H_N$ through an Nth header $H_N$ and corresponding to an integral number N of pumps, wherein X is an integer between 1 and N and wherein the sequence of said headers may be described by the sequence $H_1, H_X, \ldots H_N$, said tool further comprising at least one intermediate header $H_X$ adapted to hydraulically contain liquid sent thereto, and wherein said intermediate header $H_X$ is hydraulically connected to the output from a discharge conduit portion $H_{X-1}$ of header $H_{X-1}$ immediately therebelow, and wherein said intermediate header $H_X$ further comprises (a) peripheral sidewalls, (b) an intermediate header $H_X$ inlet, for receiving the liquid output of a selected pump $P_X$, and (c) an intermediate header $H_X$ upper side, and wherein said intermediate header $H_X$ upper side is hydraulically connected to the inlet of a discharge conduit of said intermediate header $H_X$.

18. The tool of claim 16, wherein each of said discharge conduits are comprised of a plurality of generally tubular elements, and wherein at least two of said tubular elements are of different diameter.

19. The tool of claim 5 or claim 16, wherein each of said headers further comprises a spacer (188), and wherein said spacers are generally radially affixed to said headers, said spacers adapted to locate said tool relative to a borehole during insertion into a borehole and during operation of one or more of said pumps while said tool is located in a borehole.

20. The tool of claim 1 or claim 16, wherein said outer wall section of said discharge conduit portions further comprise a plurality of generally rectangular slot shaped apertures, said ribs joined to said discharge conduit portions by insertion of said ribs at least partially into said apertures, and said ribs attached to said discharge conduit portions by weldment therebetween adjacent to said apertures.

* * * * *